US006065714A

United States Patent [19]

Fondacaro

[11] Patent Number: 6,065,714

[45] Date of Patent: May 23, 2000

[54] MACHINE FOR DISPENSING FENCE WIRE

[76] Inventor: Gregory Fondacaro, 113 Lincoln Ave., Hammonton, N.J. 08037

[21] Appl. No.: 09/203,131

[22] Filed: Dec. 1, 1998

[51] Int. Cl.[7] ..... B65H 16/02

[52] U.S. Cl. ..... 242/557; 242/403; 242/594.6

[58] Field of Search ..... 242/403, 557, 242/594.4, 594.5, 594.6, 592, 399.1

[56] References Cited

U.S. PATENT DOCUMENTS

| | | | |
|---|---|---|---|
| 485,541 | 11/1892 | Harper | 242/403 X |
| 809,721 | 1/1906 | Myers | 242/403 X |
| 906,547 | 12/1908 | Moss . | |
| 2,250,269 | 7/1941 | Lockwood | 242/403 X |
| 2,789,778 | 4/1957 | Zogg et al. . | |
| 2,851,228 | 9/1958 | Keck | 242/594.5 |
| 3,243,141 | 3/1966 | Cook et al. | 242/557 X |
| 3,356,341 | 12/1967 | Brown . | |
| 3,937,414 | 2/1976 | Bank et al. . | |
| 4,208,021 | 6/1980 | Wall . | |
| 4,369,614 | 1/1983 | Tetzner | 242/557 X |
| 4,383,398 | 5/1983 | Tipton | 242/594.5 X |
| 4,564,152 | 1/1986 | Herriage | 242/594.4 X |
| 4,611,645 | 9/1986 | Whisnant | 242/557 X |
| 5,042,737 | 8/1991 | Sigle et al. . | |
| 5,158,243 | 10/1992 | Sigle et al. . | |
| 5,163,634 | 11/1992 | Moon et al. | 242/557 X |
| 5,476,234 | 12/1995 | St. Pierre . | |
| 5,582,216 | 12/1996 | Smith et al. | 242/557 X |
| 5,632,470 | 5/1997 | Leland | 242/557 X |
| 5,806,779 | 9/1998 | Crum | 242/403 X |
| 5,836,538 | 11/1998 | Lencoski et al. | 242/399.1 X |

*Primary Examiner*—Donald P. Walsh
*Assistant Examiner*—William A. Rivera
*Attorney, Agent, or Firm*—William L. Muckelroy; Gary Lipson

[57] ABSTRACT

A mobile apparatus for dispensing fence wire, especially barbed wire, at varying heights. The apparatus consist of a base, at least one support member secured to the top of the base. The support member extends in an upward direction. The apparatus further includes a cross support member secured horizontally to the top of the support member. In addition, there is at least one spool carrying member secured to the cross support member. The spool carrying member extends outward away from the base. There are two skid receptors secured to the bottom of the base. The skid receptors are secured to the base such that the apparatus can be lifted by a forklift or other such device. There is a traverse member secured to the cross support member and the traverse member extends toward the base and in an upward direction. The apparatus also includes a wire guide that is connected to the traverse member. A purpose of the wire guide is to help guide the fence wire from the apparatus to it intended attachment point on a fence.

5 Claims, 2 Drawing Sheets

MACHINE FOR DISPENSING FENCE WIRE

BACKGROUND

This invention relates to an apparatus for dispensing fence wire; more particularly, to an improved mobile apparatus that is designed to dispense multiple strands of fence wire at varying heights.

The installation of wire fencing, including barbed wire fencing, heretofore has involved the expenditure of large amounts of time and labor. These expenditures have been necessitated by the fact that wire fencing requires the installation of multiple strands of wire. In some animal control or security applications, the situation may require the application of many as twelve strands of wire to adequately control farm livestock and/or prevent an entry or egress relative to a subject property. Typically, such fences have been installed by traversing the proposed fence line with a single reel of steel wire, securing the dispensed wire strand to the end and middle fence posts in the line, stretching the wire strand to the desired degree of tautness, securing the wire strand to the remaining posts in the fence line, and repeating the process with the next strand of wire. Handling of barbed wire poses a particular hazard because any lifting or special handling of the barbed wire subjects the handler to additional risk of injury.

In some applications, a barbed wire is applied at the top most portion of a fence. The height of this type of application could be in excess of ten (10) feet. Although fence wire dispensing machines have been in wide use as exemplified in U.S. Pat. Nos. 3,356,341, 4,208,021, 5,042,737, and 5,476,234. There is no prior art that teaches or suggests a means or method for adequately dispensing or stringing wire at varying heights, in particular at heights in excess of ten (10) feet.

SUMMARY

The present invention overcomes the shortcomings of the prior art by providing a mobile apparatus that includes a base having four sides, a top and a bottom. Support members are secured to the top of one side of the base and the support members extend in an upward direction. A cross support member is secured horizontally on top of the support members and there is at least one spool carrying member secured to the cross support member. The spool carrying member extends in an outward direction away from the base. The present invention further includes two skid receptors secured to the bottom of the base. The skid receptors are secured on opposite sides of the base, where one of the skid receptors is secured on the same said side as the aforementioned support member. The skid receptors are configured such that the invention can be lifted by a forklift or other such device to facilitate stretching wire at various heights. The present invention further includes a traverse member having a first end and a second end. The first end of the traverse member is secured to the cross support member and the traverse member extends toward the base and in an upward direction. An upward support means provides support for the traverse member, and a wire guide means is connected to the second end of the traverse member. It is contemplated that there is a wire guide associated with each of the spool carrying members.

Preferably the spool carrying members for the present invention include a plurality of rotatable spools. The rotatable spools have associated wire strand guide means which are vertically spaced from each another, with each of the spools having wire strand wound thereon. These spools preferably are supported for rotation on shaft means mounted on the dispenser frame.

It is an object of the present invention to provide a wire dispenser that is able to simultaneously dispense a plurality of wire. It is a further object of the present invention to provide a wire dispensing device that can be used to dispense wire for fences of varying heights. It is a further object of the present invention that the wire dispensing device can dispense wire at heights in excess of ten (10) feet.

It is still a further object of the present invention to provide a device that is adapted to be carried on a fork lift or other such mobile device.

Other detail and advantages of the present invention will become apparent from a consideration of the following description taken with the accompanying drawings.

DRAWINGS

These and other features, aspects, and advantages of the present invention will become better understood with regard to the following description, appended claims, and accompanying drawings where:

DESCRIPTION

The present invention will be described hereinafter with reference to the accompanying drawings which illustrate an embodiment of the invention.

Figure 1:
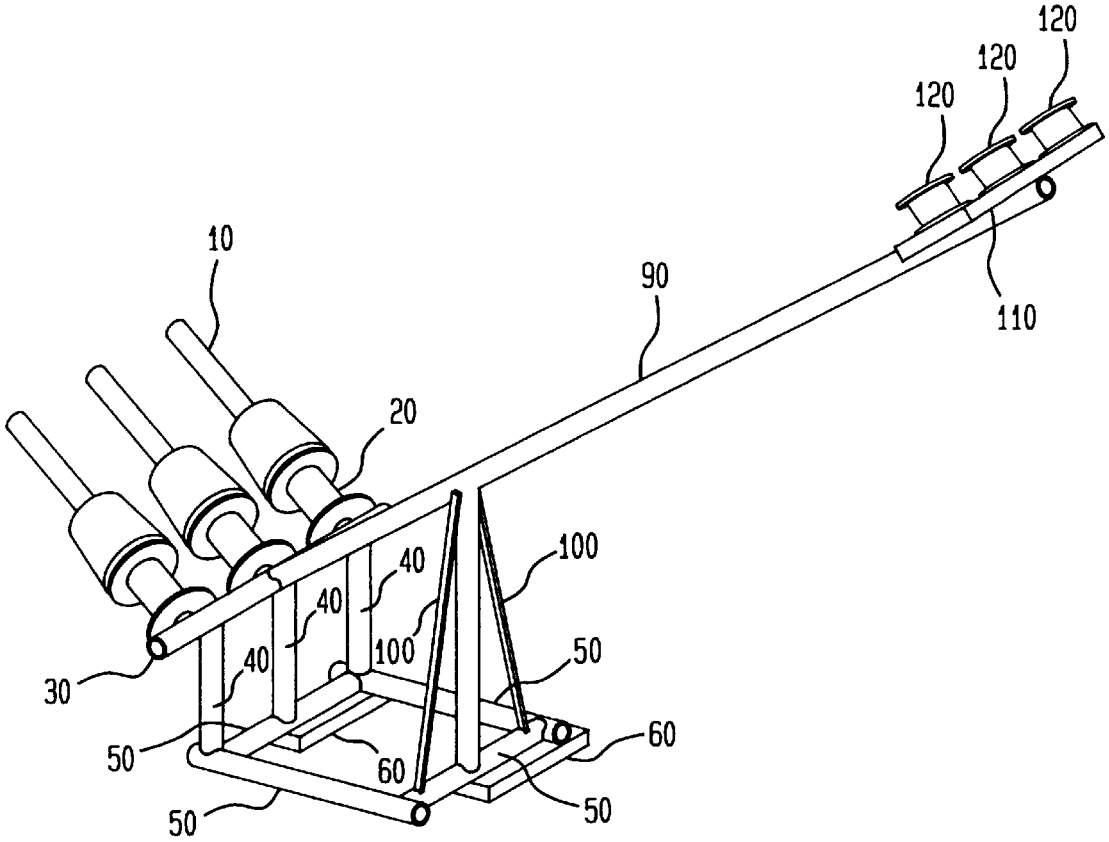
FIG. 1 is a side perspective view of one embodiment of the invention.

A machine for dispensing fence wire embodying the concept of the present invention is shown in the accompanying drawings. As seen in FIG. 1, the invention comprises four sides 50, with each side 50 having a top and a bottom. At least one support member 40 is secured to the top of one side of the base and extends in an upward direction. A cross support member 30 is secured horizontally to the at least one support member. In the present embodiment of the invention there are three spool carrying members 10 that are secured to the cross support member 30 and the spool carrying member 10 extends in an outward direction away from said base. There are two skid receptors 60 secured to the bottom of the base. The skid receptors 60 are secured to opposite sides of the base such that the invention can be lifted by a forklift or other such device to facilitate stretching wire at heights in excess of ten feet. The invention includes a traverse member 90. The traverse member 90 has a first end and a second end. The first end of the traverse member 90 is secured to the cross support member 30 and extends in an upward direction toward the base. The traverse member is supported by an upward support means 100. The upward support means 100 is secured on one end to the traverse member 90 and at another end to one side of the base. A wire guide means 110 is attached to the second end of the traverse member 90. The wire guide means 110 includes pulley arrangements, with one pulley arrangement 120 corresponding to one spool carrying member 10.

Figure 2:
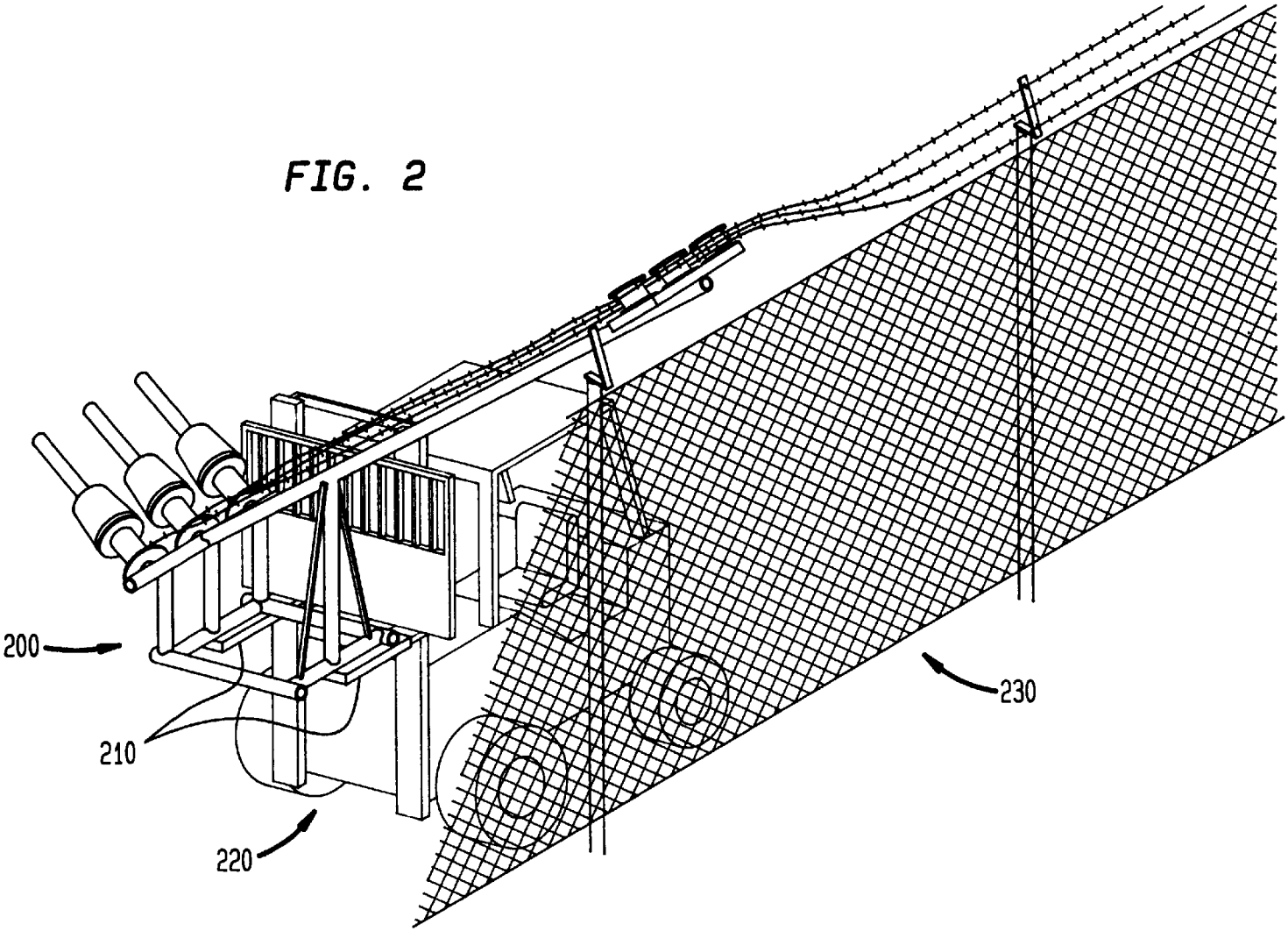
FIG. 2 is a view of the device, raised by a forklift, in use applying multiple strands of barbed wire fencing.

Referring to FIG. 2, the invention is shown generally as numeral 200. In this embodiment the invention 200 is shown having two skid receptors 210 secured to a bottom portion of the invention 200. The skid receptors 210 are adapted to receive the lifting members of a forklift 220 or other such device. It is contemplated that the forklift 220 is of raising or lowering the invention 200 to accommodate the application of wire at different heights. For example, in FIG. 2, the invention 200 is raised off the ground to facilitate the stringing of wire on the top most portion of a fence 230. As is clear from FIG. 2, there are circumstances that require the application of fence wire at varying heights

What is claimed is:

1. A device for dispensing wire, said device adapted to be carried by a forklift type vehicle, said device for dispensing wire comprising:

a base having four sides, said base having a top and a bottom;

at least one support member secured to said top of said one of said sides of said base, said at least one support member extending in an upward direction, said at least one support member having a top;

a cross support member secured horizontally to the top of said at least one support member;

at least one spool carrying member secured to said cross support member and said spool carrying member extending in an outward direction away from said base;

two skid receptors secured on said bottom of said base, said skid receptors being secured on opposite sides of said base, one of said skid receptors is secured on the same said side as said support member whereby the invention can be lifted to facilitate stretching wire at heights in excess of ten feet;

a traverse member having a first end and a second end, the first end of said traverse member secured to said cross support member and extending toward said base and in an upward direction, an upward support means providing support for said traverse member; and a wire guide means for guiding wire is connected to said second end of said traverse member.

2. A device as claimed in claim 1, wherein said upward support means includes upward support member having a first end and a second end, said first end is attached to said traverse member and said second end is attached to one said side of said base.

3. A device as claimed in claim 1, wherein there are three said support members secured to said top of said one of said sides of said base, each of said three said support members extends in an upward direction.

4. A device as claimed in claim 3, wherein the wire guide means includes a pulley arrangement, there is one said pulley arrangement corresponding to said at least one spool carrying member.

5. A device as claimed in claim 4, wherein said device is lifted by said forklift type vehicle to facilitate dispensing of wire at a height in excess often (10) feet.

* * * * *